United States Patent [19]

Gaukler

[11] Patent Number: 4,974,396

[45] Date of Patent: Dec. 4, 1990

[54] APPARATUS FOR MANUFACTURING BAGS

[75] Inventor: Fritz Gaukler, Stuttgart, Fed. Rep. of Germany

[73] Assignee: Robert Bosch GmbH, Stuttgart, Fed. Rep. of Germany

[21] Appl. No.: 392,942

[22] PCT Filed: Jan. 12, 1988

[86] PCT No.: PCT/DE88/00012

§ 371 Date: Jul. 17, 1989

§ 102(e) Date: Jul. 17, 1989

[87] PCT Pub. No.: WO88/06123

PCT Pub. Date: Aug. 25, 1988

[30] Foreign Application Priority Data

Feb. 16, 1987 [DE] Fed. Rep. of Germany ..... 3704797

[51] Int. Cl.[5] ..... B65B 9/08

[52] U.S. Cl. ..... 53/551; 493/197; 493/205

[58] Field of Search ..... 53/550, 551, 552, 554; 493/197, 202, 205, 206

[56] References Cited

U.S. PATENT DOCUMENTS

| | | | |
|---|---|---|---|
| 3,201,913 | 8/1965 | Kopp | 53/552 |
| 3,449,888 | 6/1969 | Gausman | 53/552 |
| 3,796,021 | 3/1974 | Toss . | |
| 4,043,098 | 8/1977 | Putnam et al. | 53/551 |
| 4,079,662 | 3/1978 | Puccetti et al. | 53/552 |
| 4,423,585 | 1/1984 | Monsees et al. | 53/451 |
| 4,534,159 | 8/1985 | Kelly | 53/552 |
| 4,604,854 | 8/1986 | Andreas | 53/552 |
| 4,790,124 | 12/1988 | Kaji | 53/552 |

FOREIGN PATENT DOCUMENTS 2134475 1/1973 Fed. Rep. of Germany .

*Primary Examiner*—Robert L. Spruill
*Assistant Examiner*—Linda B. Johnson
*Attorney, Agent, or Firm*—Michael J. Striker

[57] ABSTRACT

An apparatus for manufacturing bags in which a band of a packing material is shaped into a tube about a shaping mandrel and which comprises a reciprocating transverse sealing device for dividing the tube into separate bags, a rotatable conveying device frictionally engaging the tube in an area of the shaping mandrel for intermittently feeding the tube, and a drive for synchronously moving the rotatable conveying device and the transverse sealing device during feeding the tube by a bag length.

2 Claims, 1 Drawing Sheet

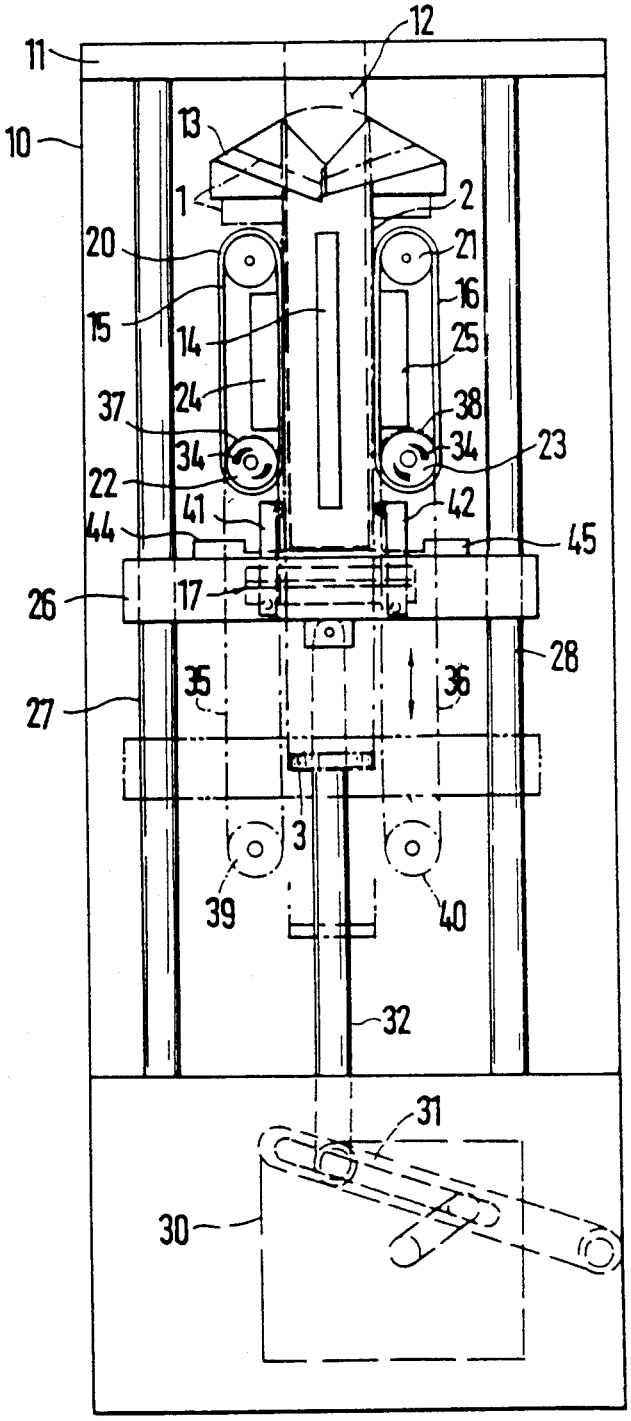
12
11
10
13
1
2
20
21
16
15
14
25
24
37
38
34
34
23
22
41
42
44
45
26
17
28
35
36
27
3
39
40
32
31
30

APPARATUS FOR MANUFACTURING BAGS

BACKGROUND OF THE INVENTION

The invention relates to an apparatus for manufacturing bags comprising a mandrel for shaping a band made from a packing material into a tube, a sealing device for dividing the tube into separate bags, and a rotatable conveying device for feeding the tube.

Apparatuses for manufacturing bags or bag packaging, in which a packing material band is shaped to form a tube, and the tube is drawn forward and divided cyclically by one bag length in each instance, are substantially divided into two types; namely, gripper feed machines and belt or roller feed machines. In gripper feed machines, the tube is fed by a bag length in each instance by a transverse sealing device which is moved in reciprocating or up-and-down motion, while the tools of the transverse sealing device simultaneously apply transverse seams to the tube and divide a bag. In these machines, the sealing time corresponds to the feed time. A disadvantage of this type of tube bag machine is that the end is shaped in a wedge-shaped manner by an exerted tension during the drawing forward of the tube, so that a formation of a base is impeded and, accordingly, the holding or volumetric capacity of the bag is not fully utilized.

In belt or roller feed machines, on the other hand, the tube is drawn forward by a bag length in a stepwise manner by a pair of conveying belts or rollers by frictional engagement, and the transverse sealing seams are applied by a stationary sealing device during every stoppage. In this type of tube bag machine, a clean standing base can be formed, but it has the disadvantage that the time for the transverse seam sealing and for the tube feed are cumulative, and the output of this type of machine is accordingly lower than that of the gripper feed machine.

Further, a tube bag machine is known from DE-OS No. 21 34 475 in which the tube feed is carried out by a reciprocated transverse sealing device as well as by conveying rollers or belts which are conveyed cyclically. In this tube bag machine, however, the transverse sealing device is moved in a reciprocating manner only a part of the length of the bag to be manufactured, and the remaining tube length for a bag to be manufactured is drawn forward with the aid of the conveying rollers or belts. In this known tube bag machine, it is very difficult to manufacture bags having the same length in each instance. Moreover, the time which is available for the transverse seam sealing is not fully used.

SUMMARY OF THE INVENTION

It is the object of the invention to provide an apparatus for manufacturing bags on which bags can be formed with a shaped base and on which bags with very strong transverse sealing seams can be manufactured. This object is achieved by providing an apparatus in which the sealing device and the rotatable feed device are driven synchronously during a conveying phase of feeding the tube.

With the apparatus, according to the invention, bags and bag packaging with sealing seams of high strength can be manufactured with very high output. Moreover, the produced bags have a large holding capacity as they are formed on a single base.

The present invention both as to its construction so to its mode of operation, together with additional objects and advantages thereof, will be best understood from the following detailed description of a preferred embodiment with reference to the appended drawings.

BRIEF DESCRIPTION OF THE DRAWINGS

A single drawing, FIGURE shows a simplified front view of a tube bag machine according to the present invention.

DESCRIPTION OF THE PREFERRED EMBODIMENT

A shaping and filling tubular mandrel 12 is suspended vertically from a plate 11 which extends out of a machine frame 10. A shaping shoulder 13 encloses the upper portion of the shaping mandrel 12, a heat-sealable packing material band 1 being drawn off from a supply roll, not shown, via the shaping shoulder 13 and is wrapped around the shaping mandrel 12 to form a tube 2. The overlapping rims of the packing material band 1, which is shaped to form a tube 2, are sealed together by a heated heat-sealing jaw 14 cooperating with the shaping mandrel 12. In order to convey the packing material band 1 and the tube 2, respectively, continuous conveying belts 15, 16 are arranged at both sides of the lower part of the shaping mandrel 12, and a transverse sealing jaw pair 17 is arranged below the shaping mandrel 12. The conveying belts 15, 16, which circulate cyclically, are guided around upper and lower deflecting rollers 20, 21 and 22, 23 in such a way that the portions of the belts facing one another between the rollers contact the outside of the tube 2 guided on the shaping mandrel 12 by frictional engagement. The two portions of the perforated conveying belts 15, 16 contacting the tube 2 run in front of suction boxes 24, 25 in which a vacuum pressure is built up.

A transverse sealing jaw pair 17 is arranged in a frame-like carriage 26 in such a way that the two transverse sealing jaws can be moved and pressed against one another, wherein they compress the tube 2 transversely and, in so doing, separate a bag 3 off from the lower end of the tube. When the bag 3 is separate, a head seam is formed at the tube 2 at the bottom, and a base seam is formed at the tube 2 at the top, and a separation of the bag 3 located between the latter is carried out.

The separation of a bag 3 is effected while the carriage 26, which is supported so that it can be raised and lowered on two vertical rods 27, 28, is moved downward by one bag length in each instance by a stepping gear unit 30 via a rocker 31 and a tie rod 32. During this feed movement, the two conveying belts 15, 16 are driven synchronously, so that the tube 2 is conveyed to the separating point not only by pulling, but also pushing a bag length in each instance. During the tube feed, a vacuum pressure is produced in the suction boxes 24, 25, so that the tube 2 is drawn securely at the conveying belts 15, 16.

In order to drive the conveying belts 15, 16, their lower deflecting rollers 22, 23 are connected in each instance with a chain drive 35, 36 via a free-running wheel 34, which chain drives 35, 36 extend downward parallel to the feed axis of the tube 2. The two chain drives 35, 36 have chain sprockets 37, 38 at the top, which are coaxial with the lower deflecting rollers 22, 23, and chain sprockets 39, 40 at the bottom. Brackets 41, 42, whose lower end is connected with the carriage 26 which is moved up and down, are articulated at the two portions of the chain drive 35, 36 which are located close to one another. As a result of this connection, the two chain drives 35, 36 are carried along during a downward movement of the carriage 26, in which the transverse sealing jaw pair 17, 18 draws the clamped together tube 2 downward, and the lower deflecting rollers 22, 23 rotate via the free running-wheels 34 which block in this direction, so that the two conveying belts 15, 16 rotate and feed the tube to the shaping mandrel 12. In the lower position of the carriage 26, the transverse sealing jaws 17 are moved apart, wherein they release the tube 2 and the separated bag 3. Thereupon, the carriage 26 is raised again. During the upward movement of the carriage 26, the latter propels the chain drives 35, 36 in the opposite direction via the brackets 41, 42, wherein the upper chain sprockets 37, 38 spin freely because of the action of the free-wheels 34 without rotating the lower deflecting rollers 22, 23 of the conveying belts 15, 16. Instead of the brackets 41, 42, pneumatic cylinders can also be provided which increase the feed path of the conveying belts relative to the transverse sealing apparatus during the tube feed by a superimposed movement, so that a particularly pronounced formation of a base at the bags is made possible.

In order to form a standing base close to the lower transverse sealing seam of a bag 3, two folding slides 44, 45 are arranged at the carriage 26 slightly above the transverse sealing jaws 17, which folding slides 44, 45 introduce a lateral fold at both sides of the tube 2 in each instance when the transverse sealing jaws 17 come together, as is known e.g. from U.S. Pat. No. 3,201,913. Such folding slides can also be arranged below the transverse sealing jaws 17 so that lateral folds can also be introduced at the head of the bag 3. A high filling capacity of the bag packaging is achieved by applying lateral folds in the head and base areas of the bag. In order to produce filled bag packaging, a quantity of filling product is introduced into the end of the tube 2 in each instance during the feeding of the tube 2 through the shaping mandrel 12. However, empty bags can also be produced with the described apparatus, wherein a filling is omitted, and only a base seam is applied to the tube by corresponding construction of the transverse sealing jaws.

It is noted, in addition, that rollers can also be arranged, instead of the conveying belts, for feeding the tube, which rollers are driven in the same way as the conveying belts. Moreover, instead of perforated conveying belts at which the tube is held by means of vacuum pressure, conveying belts or rollers whose surface enters into a favorable frictional engagement with the tube can also be used.

While the invention has been illustrated and described as embodied in an apparatus for manufacturing bags, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for manufacturing bags, comprising a mandrel for shaping a band of a packaging material into a tube; reciprocating transverse sealing means movable into engagement with the tube to form transverse seams thereon to thereby divide the tube into separate bags; first drive means for moving said transverse sealing means in engagement with the tube a bag length in a predetermined direction; rotatable conveying means for frictionally engaging the tube in an area of said shaping mandrel; and second drive means for driving said rotatable conveying means simultaneously with movement of said transverse sealing means in the predetermined direction, to effect feeding of the tube in the predetermined direction; said transverse sealing means comprising two opposite transversely movable jaws and a carriage for supporting said two opposite transversely movable jaws, said first drive means including gear means, rocker and tie rod means connected with said carriage for displacing the same, said second drive means comprising a chain drive, said apparatus further comprising means for enabling said chain drive to drive said rotatable conveying means in the predetermined direction simultaneously with movement of said transverse sealing means in the predetermined direction; and said enabling means including means at least partially supported at said carriage and engaging said chain drive, and free-running gear means.

2. An apparatus as set forth in claim 1, wherein said rotatable conveying means includes conveying belt means and deflecting roller means for supporting said conveying means, said free-running gear means being engageable with said deflecting roller means.

* * * * *